United States Patent [19]

Goering et al.

[11] 4,019,287

[45] Apr. 26, 1977

[54] SPIRAL KNIFE SHARPENER

[75] Inventors: Lowell J. Goering, Moundridge; Harold William Voth, Newton, both of Kans.

[73] Assignee: Hesston Corporation, Hesston, Kans.

[22] Filed: June 12, 1975

[21] Appl. No.: 586,420

[52] U.S. Cl. ..... 51/249; 56/250

[51] Int. Cl.[2] ..... B24B 3/42

[58] Field of Search ..... 51/249, 48 HE; 56/250

[56] References Cited

UNITED STATES PATENTS

| | | | |
|---|---|---|---|
| 1,154,712 | 9/1915 | Meyer | 51/249 |
| 1,187,807 | 6/1916 | Boling | 51/249 |
| 2,187,289 | 1/1940 | Utterback | 51/48 HE |
| 3,019,568 | 2/1962 | Sauers | 51/249 X |
| 3,479,776 | 11/1969 | Berg | 51/249 |
| 3,793,792 | 2/1974 | Wagstaff | 51/249 |
| 3,863,403 | 2/1975 | Fleming | 51/249 |

*Primary Examiner*—Al Lawrence Smith

*Assistant Examiner*—Nicholas P. Godici

*Attorney, Agent, or Firm*—Schmidt, Johnson, Hovey & Williams

[57] ABSTRACT

The cutting cylinder of a forage harvester has helically oriented knives which may be sharpened by shifting a spinning grinding stone back and forth across the housing for the cylinder in parallel relationship with the axis of rotation of the cylinder. Opposed sets of roller guides which move with the stone in its straight line reciprocation trap the blade being sharpened and force the cylinder to rotate to such an extent and in such a direction as to continuously maintain the bevel on the knife engaged with the stone, thereby compensating for the helical orientation of the knife. One set of roller guides rides along the normally leading edge of the knife being sharpened, while the other set of opposed roller guides rides along the outer surface of the knife being sharpened.

9 Claims, 6 Drawing Figures

SPIRAL KNIFE SHARPENER

This invention relates to the sharpening of spiral or helical knives on the cutting cylinder of a forage harvester and has as one important object thereof to accomplish such sharpening in situ with minimum complications and maximum speed and efficiency.

Another important object of this invention is to provide a relatively non-complex means for advancing the cutting cylinder in the properdirection and in an appropriate amount to always maintain the helically curving bevel on the knife being sharpened in engagement with the sharpening stone as the latter is driven back and forth in a straight line parallel to the axis of rotation of the cylinder.

A more specific important object of this invention is to trap the knife being sharpened between opposed guides that travel with the sharpening stone such that the cylinder is advanced and retreated solely by the trapping guides, thereby eliminating the need for more costly and complicated-to-use indexing mechanisms, levers, cranks and springs heretofore found on prior sharpeners.

A still further important object of the present invention is to provide proper advancement and retreat of the cutting cylinder through an arrangement that gauges off of the knife being sharpened, rather than off of a previous or subsequent knife such that nicks, gouges and other surface irregularities existing in one knife will not be carried over to another.

KNOWN PERTINENT PRIOR ART

| KNOWN PERTINENT PRIOR ART | | |
|---|---|---|
| 3,724,139 | Leverenz | April 3, 1973 |
| 3,726,047 Long | April 10, 1973 | |
| 3,793,792 | Wagstaff et al | February 26, 1974 |

Figure 2:
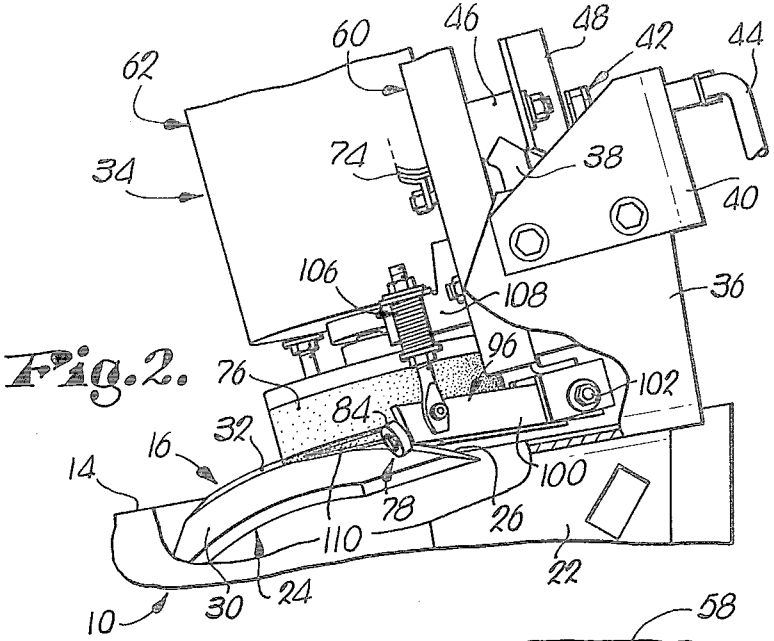
FIG. 2 is a fragmentary opposite side elevational view of the cutter and sharpener, parts again being broken away.

The forage harvester cutter 10 includes a housing 12 that is open across its top 14 to expose cutting cylinder 16. The latter has a central shaft 18 journaled for rotation by bearings 20 on opposite sides 22 of housing 12, and it also includes a number of elongated knives 24, one only being shown throughout the figures. Each knife 24 is wound in a spiral or helical fashion around the shaft 18 between housing sides 22 and has a normally leading edge 26, an inner surface 28, an outer surface 30, and a bevel 32 extending between edge 26 and outer surface 30.

A sharpener 34 includes supporting framework in the form of a pair of angle brackets 36 extending outwardly from opposite housing sides 22 and a track 38 extending between brackets 36 above and across housing 10. A pair of right angle supports 40 secured to the brackets 36 and extending in part along the front of track 38 carry a chain and sprocket assembly 42 which extends along and in front of track 38 between supports 40. A hand crank 44 at one end of assembly 42 may be operated to drive the latter.

Figure 3:
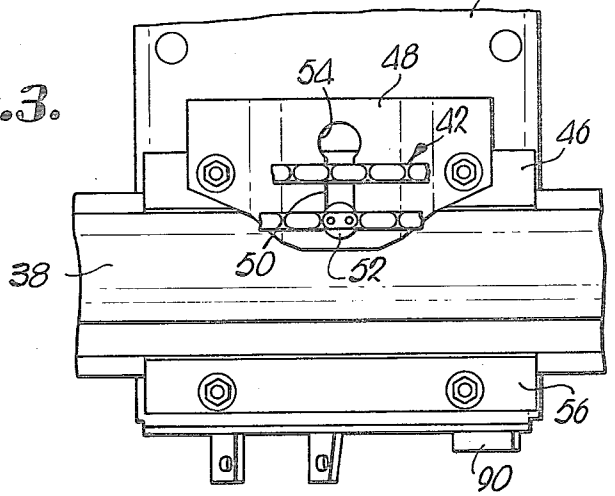
FIG. 3 is a fragmentary front elevational view of the cutter and sharpener illustrating details of construction.
Figure 1:
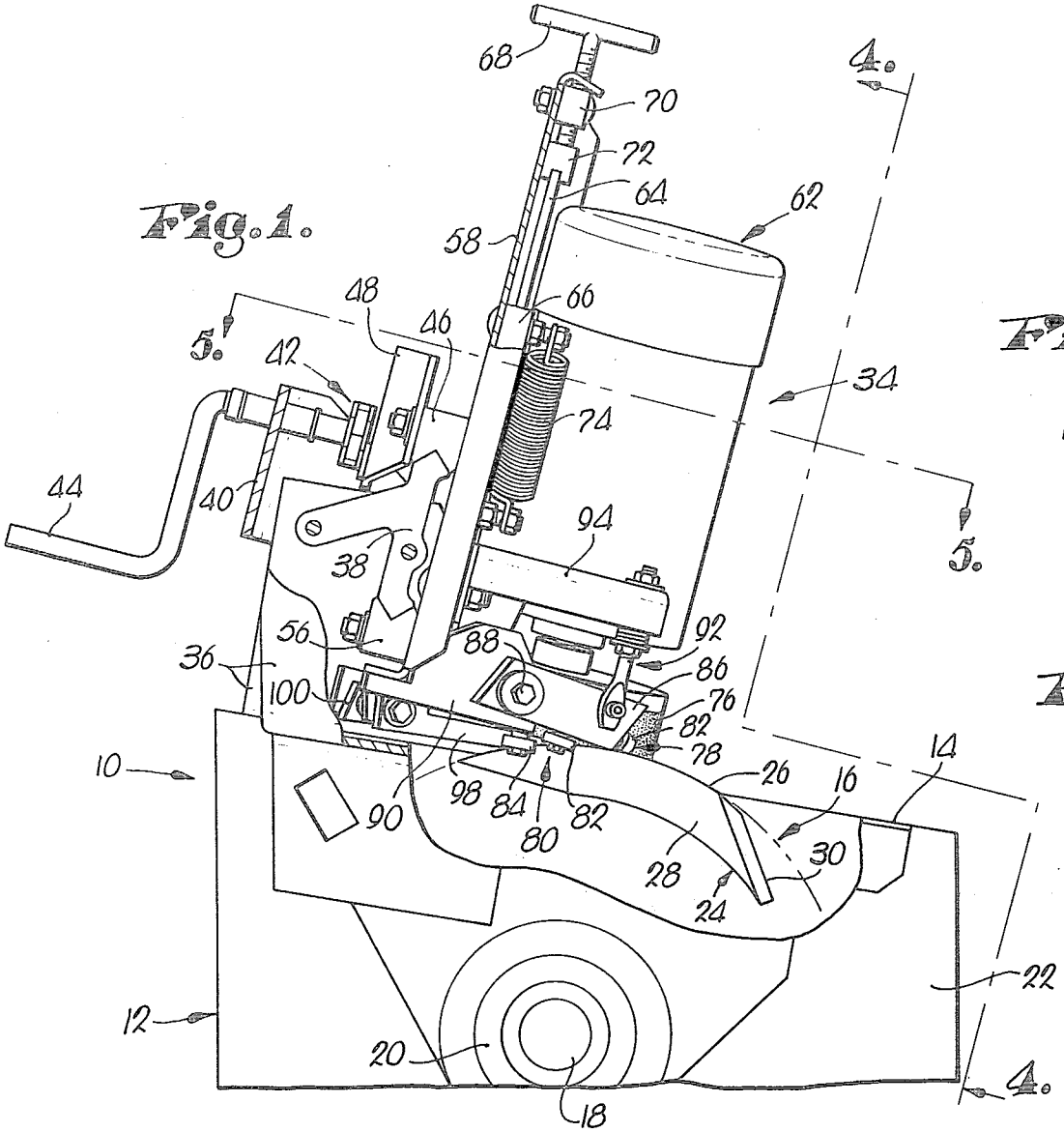
FIG. 1 is a fragmentary side elevational view of a forage harvester cutter employing a knife sharpener constructed in accordance with the principles of the present invention, parts being broken away to reveal details of construction.

Assembly 42 is operably coupled with an elongated slide block 46 on the top of track 38 by a formed bracket 48. As shown in FIG. 3, bracket 48 has a keyslot 50 therein which receives a retainer 52 carried by chain and sprocket assembly 42, the key slot 50 having an enlarged circular area 54 at one end for the retainer 52. This arrangement permits continuous operation of assembly 42 by crank 44 and reciprocates the guide block 46 back and forth along track 38 without necessitating reversal of the initial direction of rotation of crank 44.

Slide block 46, as well as a second slide block 56 along the lower side of track 38, is secured to the rear of an upstanding plate 58 which forms a carriage 60 for an electric grinder. Grinder 62 is secured to a second upright plate 64 smaller in size than plate 58 and received within the confines of the latter by a pair of upright, notched blocks 66 that serve to guide plate 64 for vertical reciprocation. Such vertical movement of plate 64 and hence grinder 62 is controlled by a T-handle 68 threadably received by a component 70 adjacent the top of plate 58. The lower end of the shank of handle 68 abuts a shoulder 72 on the top edge of plate 64 so as to push the latter downwardly when handle 68 is rotated in the appropriate direction, such downward pushing being yieldably resisted by a pair of coil springs 74 which interconnect the large plate 58 and smaller plate 64. Thus, the circular grinding element 76 projecting from the bottom of grinder 62 may be moved toward and away from the cutting cylinder 16 as required in order to properly engage element 76 with the bevel 32 on a knife 24 to be sharpened.

A pair of guides 78 and 80, each including a pair of rollers 82 and 84 spaced apart longitudinally with respect to the cutting reel 16, are disposed to trap the knife 24 to be sharpened. In this respect it may be seen perhaps most clearly in FIG. 6 that the rollers 82 and 84 of guide 78 ride along the outer surface 30 of knife 24 while the rollers 82 and 84 of guide 80 ride along the leading edge 26, thereby effectively capturing knife 24 against independent movement of the latter.

The rollers 82 are mounted for movement with the carriage 60 and the grinder 62 by arm structure 86 that is swingably mounted by a pivot bolt 88 to a bracket 90 rigidly affixed to the lowermost end of large plate 58. Arm 86 is spring loaded downwardly by a spring unit 92 coupled between arm 86 and an upper outwardly extending member 94 also rigidly affixed to the large plate 58.

The arrangement for rollers 84 is somewhat different in that they are carried by a generally U-shaped support structure 96 (viewing FIG. 5), the latter having a pair of legs 98 and 100 each pivoted to the large plate 58 by a pivot bolt 102, and a bight 104 that rigidly interconnects legs 98 and 100 adjacent their outer end. Bight 104 extends beyond leg 98 and there supports the roller 84 of guide 80, while the leg 100 extends beyond bight 104 and at its outer end supports the roller 84 of guide 78. The support structure 96 is spring biased downwardly by a spring unit 106 similar in construction to spring unit 92. Unit 106 interconnects the leg 100 of support structure 96 and an outwardly projecting member 108 affixed rigidly at its rearmost end to the large plate 58.

The grinding element 76 is hollow, having an internal cavity 110 as revealed in FIG. 2 which is open across the bottom of element 76. Hence, there is sufficient room for cavity 110 to at least partially receive the bight 104 of support structure 96, as well as the roller 84 of guide 80, allowing the latter roller 84 to be positioned closer to its corresponding edge roller 82 than is the case with rollers 82 and 84 of guide 78.

OPERATION

Figure 4:
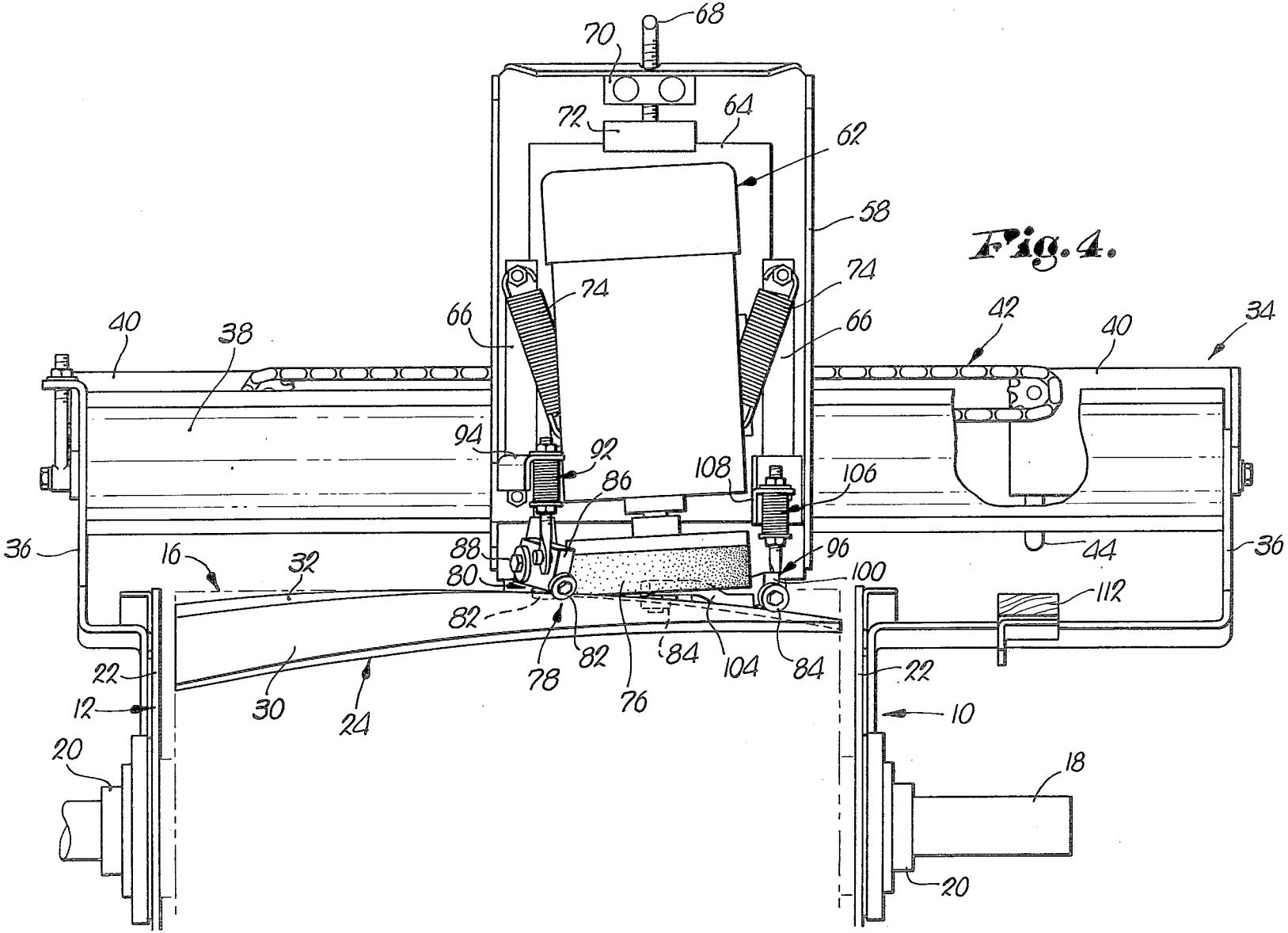
FIG. 4 is an elevational view of the cutter and sharpener taken substantially along line 4—4 of FIG. 1.
Figures 5, 6:
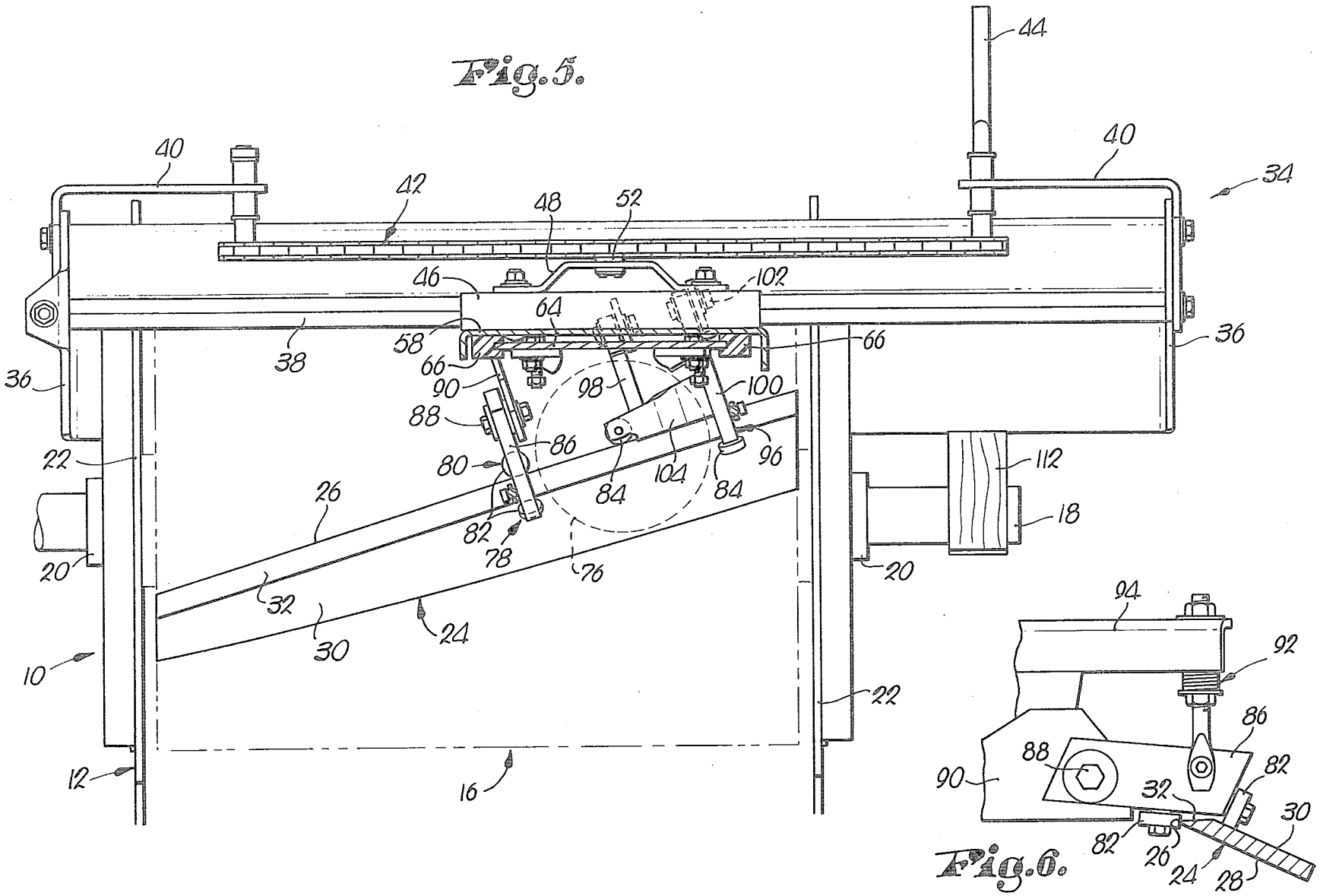
FIG. 5 is a generally horizontal cross-sectional view of the sharpener and cutter taken along line 5—5 of FIG. 1, parts being broken away and removed for clarity.
FIG. 6 is an enlarged, fragmentary detail view of the sharpener illustrating the manner in which opposed guide rollers trap the knife being sharpened.

The carriage 60 is normally stored to the right of its position shown in FIGS. 4 and 5 outside of the right side wall 22 adjacent bracket 36. In such position the grinder 62 may be lowered to bring the grinding element 76 into engagement with a wood block 112 or the like, carried by bracket 36, which helps stabilize grinder 62 during field use of the forage harvester. A cover (not shown) normally closes the open top 14 of housing 22, and after this has been removed, the operator may turn crank 44 to shift carriage 60 along track 38 into position to begin sharpening. A shear pin or the like (not shown) normally connecting the shaft 18 of cylinder 16 with drive mechanism on the harvester is pulled to allow cylinder 16 to free-wheel, and the first knife 24 is manually brought into alignment with the trapping guides 78 and 80 in the relationship illustrated in FIG. 6. Element 76 may be raised or lowered as required at this time by T-handle 68 in order to bring element 76 into engagement with bevel 32, whereupon rotation of crank 44 in the appropriate direction causes carriage 60 to advance along track 38.

Inasmuch as the knife 24 is trapped by guides 78 and 80 against independent movement, cylinder 16 is forced to rotatively advance as carriage 60 is moved rectilinearly, thereby maintaining the bevel 32 fully engaged with element 76 over the full length of knife 24. When carriage 60 reaches its left end of travel viewing FIG. 5, it, without stopping, returns to the right, causing the cylinder 16 to be retreated in the opposite rotative direction in order to maintain bevel 32 engaged with grinding element 76.

This relatively non-complex but highly effective way of compensating for the curvature in knife 24 assures that the bevel 32 will be properly ground over the full length of knife 24. Compensating rotation of cylinder 16 is effected through a direct transmission of motive force between the carriage 60 and knife 24 through the trapping roller guides 78, 80 rather than through the complicated arrangement of cranks, levers and gears coupled with the shaft 18, thereby providing more accurate grinding that is less vulnerable to tolerance build-up and fabrication errors which might be present in the more complicated previous arrangements.

The capability of positioning the roller 84 of guide 80 close to its corresponding edge roller 82 is also of significant benefit because this places a gauging or locating means close to the point of contact between element 76 and bevel 32 when the rollers 82 are moved off the left end of knife 24 viewing FIGS. 4 and 5 as the carriage 60 approaches its leftmost end of travel. Note that the grinder 62 is tilted slightly with respect to the knife 24 such that only its left peripheral portion viewing FIG. 4 actually contacts the bevel 32. Thus, by having roller 84 of guide 80 positioned directly beneath grinding element 76 and within cavity 110, a gauging means is located fairly close to the point of contact between element 76 and knife 24 even when rollers 82 are off the end of knife 24. This help assure a smoother more uniform beveling action.

Note further that the spring units 92 and 106 tend to force the leading edge 26 into constant contact with the edge rollers 82 and 84. As units 92 and 106 push their respective arms 86 and supports 96 downwardly in a clockwise direction viewing FIG. 6, the result is for the rollers 82 and 84 of guide 78 to advance cylinder 16 slightly so as to engage edge 26 with the edge rollers 82 and 84 of guide 80. Thus, very positive control is maintained over the knife 24, there being little opportunity for the latter to vibrate guides 78 and 80, while at the same time, surface irregularities can of course be compensated for by the units 92 and 106.

The significance of gauging off of the same knife that is being sharpened is also noteworthy because in this manner each knife 24 is sharpened without regard to the surface irregularities of previous or subsequent knives. Hence, although one knife might have a substantial nick, this is not carried over to the other knives.

Having thus described the invention, what is claimed as new and desired to be secured by Letters Patent is:

1. In combination with a crop cutting cylinder rotatable about its own longitudinal axis and having at least one elongated knife extending helically about said axis, said knife having a normally leading edge, an outer surface, and a bevel between said edge and said surface, a sharpener for said knife comprising:
   - a grinding element;
   - means mounting said element for reciprocation along a path of travel parallel with said axis of the cylinder and in engagement with the bevel of said knife; and
   - a pair of opposed guides disposed for trapping said knife between the same when the element is reciprocated;
   - said guides being mounted for movement with said element whereby during said reciprocation of the latter the cylinder is rotated to the extent and in the direction necessary to maintain the bevel of the knife engaged with the element,
   - one of said guides being disposed for engagement with said leading edge of the knife and the other being disposed for engagement with said outer surface of the knife.

2. A sharpener as claimed in claim 1, wherein said guides are provided with structure mounting the same for swinging movement toward and away from said knife, said structure having means yieldably biasing the same toward each knife.

3. A sharpener as claimed in claim 2, wherein each guide includes a pair of rollers spaced apart longitudinally with respect to the path of travel of the element.

4. A sharpener as claimed in claim 3, wherein the rollers of said one guide are closer together than the rollers of said other guide.

5. In combination with a crop cutting cylinder rotatable about its own longitudinal axis and having at least one elongated knife extending helically about said axis, said knife having a normally leading edge, an outer surface, and a bevel between said edge and said surface, a sharpener for said knife comprising:

a grinding element;

means mounting said element for reciprocation along a path of travel parallel with said axis of the cylinder and in engagement with the bevel of said knife; and a pair of opposed guides disposed for trapping said knife between the same when the element is reciprocated, said guides being mounted for movement with said element whereby during said reciprocation of the latter the cylinder is rotated to maintain the bevel of the knife engaged with the element, each of said guides including a pair of rollers spaced apart longitudinally with respect to the path of travel of the element.

6. A sharpener as claimed in claim 5, wherein the rollers of one guide are disposed for engagement with said leading edge of the knife and the rollers of said other guide are disposed for engagement with said outer surface of the knife.

7. A sharpener as claimed in claim 5, wherein the rollers of said one guide are closer together than the rollers of said other guide.

8. In combination with a crop cutting cylinder rotatable about its own longitudinal axis and having at least one elongated knife extending helically about said axis, said knife having a normally leading edge, an outer surface, and a bevel between said edge and said surface, a sharpener for said knife comprising:

a grinding element;

means mounting said element for reciprocation along a path of travel parallel with said axis of the cylinder and in engagement with the bevel of said knife; and a pair of opposed guides disposed for trapping said knife between the same when the element is reciprocated, said guides being mounted for movement with said element whereby during said reciprocation of the latter the cylinder is rotated to the extent and in the direction necessary to maintain the bevel of the knife engaged with the element, said guides being provided with structure mounting the same for swinging movement toward and away from said knife, said structure having means yieldably biasing the same toward said knife.

9. A sharpener as claimed in claim 8, wherein each guide includes a pair of rollers spaced apart longitudinally with respect to the path of travel of said element, the rollers of one guide being disposed for engagement with said leading edge of the knife and the rollers of said other guide being disposed for engagement with said outer surface of the knife.

* * * * *